US008701347B2

(12) United States Patent
Hampel et al.

(10) Patent No.: US 8,701,347 B2
(45) Date of Patent: Apr. 22, 2014

(54) CARRIER FOR CONNECTING A WINDOW PANE TO A WINDOW LIFT OF A MOTOR VEHICLE

(75) Inventors: Klaus Hampel, Coburg (DE); Juergen Knorr, Weidhausen (DE); Erik Langmann, Auburn Hills, MI (US); Michael Rattei, Lautertal (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 248 days.

(21) Appl. No.: 12/823,970

(22) Filed: Jun. 25, 2010

(65) Prior Publication Data

US 2010/0325962 A1 Dec. 30, 2010

(30) Foreign Application Priority Data

Jun. 29, 2009 (DE) ..... 10 2009 031 565

(51) Int. Cl.
*E05F 15/16* (2006.01)

(52) U.S. Cl.
USPC ..... 49/349; 49/372; 49/374; 49/375

(58) Field of Classification Search
USPC ..... 49/372, 374, 375, 348, 349, 157
See application file for complete search history.

(56) References Cited

U.S. PATENT DOCUMENTS

| | | | | |
|---|---|---|---|---|
| 4,051,632 | A | 10/1977 | Fukumoto et al. | |
| 4,183,178 | A | 1/1980 | Kiefer et al. | |
| 4,848,032 | A * | 7/1989 | Ballor et al. | 49/350 |
| 5,729,930 | A * | 3/1998 | Schust et al. | 49/375 |
| 5,987,820 | A * | 11/1999 | Shibanushi | 49/375 |
| 6,453,617 | B1 * | 9/2002 | Klippert et al. | 49/375 |
| 6,966,149 | B2 * | 11/2005 | Fenelon | 49/375 |
| 2004/0107645 | A1 * | 6/2004 | Galliani | 49/375 |
| 2006/0010776 | A1 | 1/2006 | Jutzi | |

(Continued)

FOREIGN PATENT DOCUMENTS

| | | | |
|---|---|---|---|
| DE | 198 19 953 | A1 | 11/1999 |
| DE | 198 60 745 | A1 | 7/2000 |

(Continued)

OTHER PUBLICATIONS http://www.merriam-webster.com/dictionary/claw Merriam-Webster's Online Dictionary, 11th Edition.*

(Continued)

*Primary Examiner* — Katherine Mitchell
*Assistant Examiner* — Marcus Menezes
(74) *Attorney, Agent, or Firm* — Christie, Parker & Hale, LLP

(57) ABSTRACT

A carrier for connection of a window pane to a window lift of a motor vehicle comprises guiding claws spaced apart from each other in a longitudinal direction of a guide rail of the window lift for guiding the carrier on the guide rail. The carrier includes a window pane holder for connecting the window pane with the carrier and an adjusting device for adjusting the position and/or orientation of the window pane with respect to the guide rail. To ensure an exact bearing of the window pane on an associated sealing contour on a motor vehicle body with simple constructive means, little mounting effort and few components, at least one guiding claw is adjustable in a direction vertical to the longitudinal extension of the guide rail or in longitudinal extension of the guide rail and vertical to the longitudinal extension of the guide rail.

17 Claims, 10 Drawing Sheets

(56) References Cited

U.S. PATENT DOCUMENTS

| | | | | |
|---|---|---|---|---|
| 2006/0130407 | A1* | 6/2006 | Castellon | 49/375 |
| 2006/0260200 | A1* | 11/2006 | Bigourden | 49/374 |
| 2007/0022665 | A1* | 2/2007 | Bigourden et al. | 49/375 |
| 2007/0125000 | A1* | 6/2007 | Fenelon | 49/349 |
| 2009/0007494 | A1* | 1/2009 | Pavlovic et al. | 49/349 |
| 2009/0064590 | A1 | 3/2009 | Sasaki et al. | |

FOREIGN PATENT DOCUMENTS

| | | | |
|---|---|---|---|
| DE | 199 56 756 | C2 | 9/2001 |
| DE | 101 45 180 | A1 | 4/2003 |
| DE | 103 31 002 | A1 | 4/2004 |
| DE | 103 31 005 | A1 | 4/2004 |
| DE | 10 2004 031 804 | B3 | 6/2005 |
| DE | 101 45 180 | B4 | 7/2005 |
| DE | 10 2004 048 017 | A1 | 3/2006 |
| DE | 203 21 385 | U1 | 2/2007 |
| DE | 10 2009 011 120 | A1 | 9/2010 |
| GB | 2468405 | A | 8/2010 |
| WO | WO99/57400 | | 11/1999 |

OTHER PUBLICATIONS

European Search Report dated Oct. 21, 2010 for Application No. EP 10 16 7340.8, 6 sheets.

European Examination Report dated Mar. 14, 2012 for Application No. EP 10 167 340.8, 5 sheets.

* cited by examiner

CARRIER FOR CONNECTING A WINDOW PANE TO A WINDOW LIFT OF A MOTOR VEHICLE

CROSS-REFERENCE TO A RELATED APPLICATION

This application claims priority to and the benefit of German Patent Application Number 10 2009 031 565.9, filed on Jun. 29, 2009, the entire contents of which are incorporated herein by reference.

BACKGROUND

This invention relates to a carrier for connection of a window pane to a window lift of a motor vehicle according to the generic part of claim 1.

Such carrier is associated to a motor vehicle door or motor vehicle body via at least one guide rail and includes a base body and a holding body constituting a window pane holder, wherein the base body is guided on the guide rail of the window lift and the window pane is attached to the holding body.

The connection of the window pane to the window pane holder in the shape of a holding body herein takes place such that the window pane extends along a window plane when the window pane is connected to the carrier. In other words the window pane holder is constituted for connecting the window pane to the carrier along a window plane. The window pane holder, hence, defines an intended position for connecting the window pane to the window lift such that it can be adjusted in a per se known manner for closing a window opening of the vehicle door.

The window pane in this context may be slightly bent, according to the constitution and shape of the window pane.

The guide rail (or the guide rails when using a window lift comprising multiple guide rails) extends (extend) substantially parallel to the window plane and defines (define) a guide of the window pane along the longitudinal extension of the guide rail (or the guide rails).

During assembly of the window lift, the spatial position, in particular the inclination of the window pane, is adjusted by an adjusting device, in order to provide for an exact bearing of the window pane on an associated sealing contour on the vehicle body.

An exact, sealing bearing of the window pane on the sealing contour in particular is required in frameless motor vehicle doors, in which in contrast to a motor vehicle door with frame, in which the window pane is guided in the frame and sealing is effected between the door frame and the body, the side window directly bears on the sealing contour of the vehicle body in the closed condition and with closed motor vehicle door. In the closed condition and with closed motor vehicle door, the window pane of a frameless motor vehicle door therefore must firmly urge against the sealing contour of the vehicle body, in order to ensure a reliable sealing. For this purpose, the window pane is slightly pretensioned in direction of the sealing contour and thus effects the required contact pressure.

From WO 99/57400 an adjustable carrier for connection of a window pane to a window lift of a motor vehicle door is known, which is associated to the motor vehicle door via guide rails and substantially consists of a base body guided on the guide rail of the window lift and of a holding body, in which the window pane is clamped. The holding body can be swiveled with respect to the base body by means of an articulated connection provided between the base body and the holding body, in that an adjusting means to be actuated by a tool directly or indirectly changes the position of the holding body with respect to the base body.

From DE 101 45 180 A1, an adjustable carrier for connection of a window pane to a window lift is known, which includes a base body guided in a guide rail of the window lift and a holding body for holding the window pane. Via a joint, the holding body is pivotally connected with the base body, wherein for an exact positioning of the holding body with respect to the base body and hence for fixing the orientation of the window pane blocking means are provided, which act on the holding body under pretension, so that upon swiveling the holding body with respect to the base body they are moved into a position in which they block a swiveling back of the holding body in opposite direction and thereby obtain the previously adjusted position of the window pane.

SUMMARY

It is an object of the present invention to ensure an exact bearing of the window pane on an associated sealing contour on a motor vehicle body with simple constructive means, little assembly effort and few components.

The solution in accordance with the invention effects an exact bearing of the window pane on an associated sealing contour on the motor vehicle body with simple constructive means, little assembly effort and few components.

The solution in accordance with the invention is based on the idea to perform the adjustment of the carrier in Y-direction of the motor vehicle, i.e. vertical to the longitudinal extension of the guide rail, directly on the guides of the carrier on the guide rail, so as to adjust the pretension of the window pane of a window lift in particular for frameless motor vehicle doors in Y-direction, without requiring an articulated or otherwise adjustable connection of a multipart carrier composed of a base body and a holding body. As a result, the same can for example also be formed integrally with a holding shaft or a claw for the window pane or be provided with a pressing plate which urges the window pane against the carrier base body.

The Y-direction in this context denotes, according to the conventional definition used in automotive industry, the vehicle transverse direction, whereas the X-direction denotes the vehicle longitudinal direction and the Z-direction denotes the vehicle vertical direction.

In its intended position the window plane extends substantially along the X- and the Z-direction (wherein the window plane may slightly differ from the plane defined by the X- and the Z-direction due to the specific shape and constitution of the window pane). The adjustability of the at least one guiding claw is provided in at least one direction perpendicular to the window pane, namely the Y-direction, wherein in addition also an adjustability in other directions may be provided.

In addition, the adjustment of the carrier directly in its guides on the guide rail provides for

- a purely translatory, in particular linear, adjustment of the carrier in Y-direction by uniform adjustment of two guiding claws by means of a common adjusting device,
- a translatory, in particular linear, adjustment of the carrier in Z-direction of the motor vehicle with superposition of an adjustment in Y-direction by an adjusting device with wedge-shaped or connecting link guide,
- a rotary or tilting movement by adjustment of an adjustable guiding claw about a non-adjustable guiding claw of the tilting axis,
- a combined translatory and rotary adjustment in the arrangement with two adjustable guiding claws each connected with an adjusting device, or an oppositely directed adjustment of two adjustable guiding claws by means of a common adjusting means for large tilting angles.

Due to the omission of an articulated connection between a carrier composed of a base body and a holding body, both the manufacturing effort for the one-part carrier in the simplest case and the assembly effort is reduced by a simple and variable adjustment, and due to the compact design of the (one-part) carrier and the omission of wedge-shaped and articulated connections in the carrier the installation space required for the window lift in the motor vehicle door is reduced.

For adjusting the position and orientation of the carrier or base body of the carrier with the holding body connected with the base body and holding the window pane with respect to the pull-off line of the window pane defined by the guide rail, the adjustable guiding claw can be adjustable vertical to and in the direction of the longitudinal extension of the guide rail, as an alternative to an adjustment vertical to the longitudinal extension of the guide rail, i.e. in Y-direction of the motor vehicle.

Beside a very simple configuration of the adjusting device, such a combined adjustment in Z- and Y-direction provides for a sensitive adjustment in Y-direction in dependence on the amount of Y-displacement during an adjustment of the adjustable guiding claw in Z-direction of the motor vehicle.

For adjusting the position and orientation of the carrier with respect to the pull-off line of the window pane defined by the guide rail, the second guiding claw can either non-adjustably be guided on the guide rail or likewise be adjustable, whereby the possibilities for adjustment are expanded.

When the second guiding claw is non-adjustably guided on the guide rail, a translatory, in particular linear, adjustment of the movable guiding claw is converted into a tilting movement of the carrier about the immovable guiding claw as axis of rotation.

In the case of two adjustable guiding claws arranged at a distance from each other in longitudinal direction of the guide rail, both adjustable guiding claws can be connected with a common adjusting device or each with one adjusting device. If a common adjusting device associated to both adjustable guiding claws is provided, an equidirectional or oppositely directed adjustment of the adjustable guiding claws can be effected depending on the configuration of the adjusting device and upon actuation of the adjusting device a different path of adjustment can be effected by corresponding configuration of one or more adjusting gears integrated in the adjusting device.

In the case of guiding claws adjustable with respect to each other in opposite directions, an expansion of the swivel angle is provided upon adjustment of the adjustable guiding claws, so that the position and orientation of the carrier can be varied in a wide range. This is advantageous in particular when the carrier is used with adjustable window lifts for different types of vehicle, so that a particularly economic manufacture and easy storage of window lifts equipped with such carriers is ensured.

Preferably, the carrier includes a base body which is guided on the guide rail of the window lift via the at least two guiding claws and by means of a holding body connected with the base body for holding the window pane.

Since the solution in accordance with the invention provides no relative adjustment between the base body and the holding body, the holding body can be designed very simple. Thus, the holding body can consist for example of a simple holding shaft arranged in a one-part base body or of a pressing plate which is urged against a side face of the carrier, so that the window pane is clamped between the base body and the pressing plate.

In dependence on the configuration of the adjusting device, the same can include adjusting means formed on the adjustable guiding claw, which are translatorily adjustable vertical to the longitudinal extension of the guide rail (Y-direction of the motor vehicle) or both vertical to the longitudinal extension of the guide rail (Y-direction) and in direction of the longitudinal extension of the guide rail (Z-direction).

For the translatory adjustment of the adjusting means in Y-direction or in Z-direction with superimposed adjustment in Y-direction, a wedge-shaped or connecting link guide can be provided for the adjustment of the adjusting means, in that the wedge-shaped or connecting link guide is form to extend vertically or at an angle with respect to the longitudinal extension of the guide rail.

For a translatory, in particular linear, adjusting movement the guiding claw holder includes two guide legs extending parallel to each other and arranged at a distance from each other with guides arranged thereon, and the movable guiding claw member includes an adjusting body with counter-guides engaging in the guides and slidingly adjustable in the guides.

For a translatory adjustment in accordance with a first embodiment, the guides and counter-guides consist of connecting link guides with grooves and webs and with webs and grooves, respectively, slidingly guided therein.

In a second embodiment, the guides are configured as box sections formed in the guide legs and extending at an angle with respect to the longitudinal extension of the guide rail and as a guide tongue arranged between the guide legs with a guide surface aligned parallel to the extension of the box sections, and the counter-guides are configured as guide webs engaging in the box sections and protruding from the adjusting body and as a movable guide surface bearing on the guide surface of the guide tongue and sliding along the same upon adjustment of the movable guiding claw member.

In this second embodiment, the adjusting means form larger support and guide surfaces in Y-direction of the motor vehicle and thus an improved translatory guidance for adjustment of the carrier.

In a preferred aspect, the adjusting device includes a tool holder for a turning tool and an adjusting gear which converts a rotation of the turning tool into a translatory adjusting movement of the adjusting means.

The adjusting gear preferably can constitute a helical gear which includes an adjusting tab connected with the base body or formed in the base body with an internal thread and an adjusting screw adjustable via the tool holder, whose external thread is in engagement with the internal thread of the adjusting tab and whose screw shank is provided with a coupling ring which engages in a coupling groove of a coupling claw connected with the adjustable guiding claw.

Alternatively, a rack-and-pinion gear, an eccentric gear or the like can be provided, with which the adjustment of the adjustable guiding claw is realized from any angle with respect to the direction of adjustment of the adjustable guiding claw.

For this purpose, the tool holder can be formed as internal polygon in which a turning tool provided with an external polygon engages, so that a very sensitive adjustment of the at least one adjustable guiding claw is ensured.

Preferably, the tool holder is aligned parallel to the longitudinal extension of the guide rail such that the turning tool can be inserted into the tool holder from the shaft opening or from the shaft bottom of the motor vehicle door, so that an adjustment of the position and orientation of the carrier with respect to the pull-off line of the window pane defined by the guide rail is possible in the completely mounted condition of the window lift and thereby an optimum bearing of the window pane in particular on the sealing contour of the vehicle body is ensured in the case of a frameless window pane.

BRIEF DESCRIPTION OF THE DRAWINGS

Further important features and advantages of the invention can be taken from the sub-claims, from the Figures of the drawing and from the associated description of Figures.

With reference to an embodiment illustrated in the drawing and the subsequent description of the Figures of the drawing the ideas underlying the invention and further variants of the solution in accordance with the invention will be explained in detail. In the drawing.

DETAILED DESCRIPTION

Figure 1:
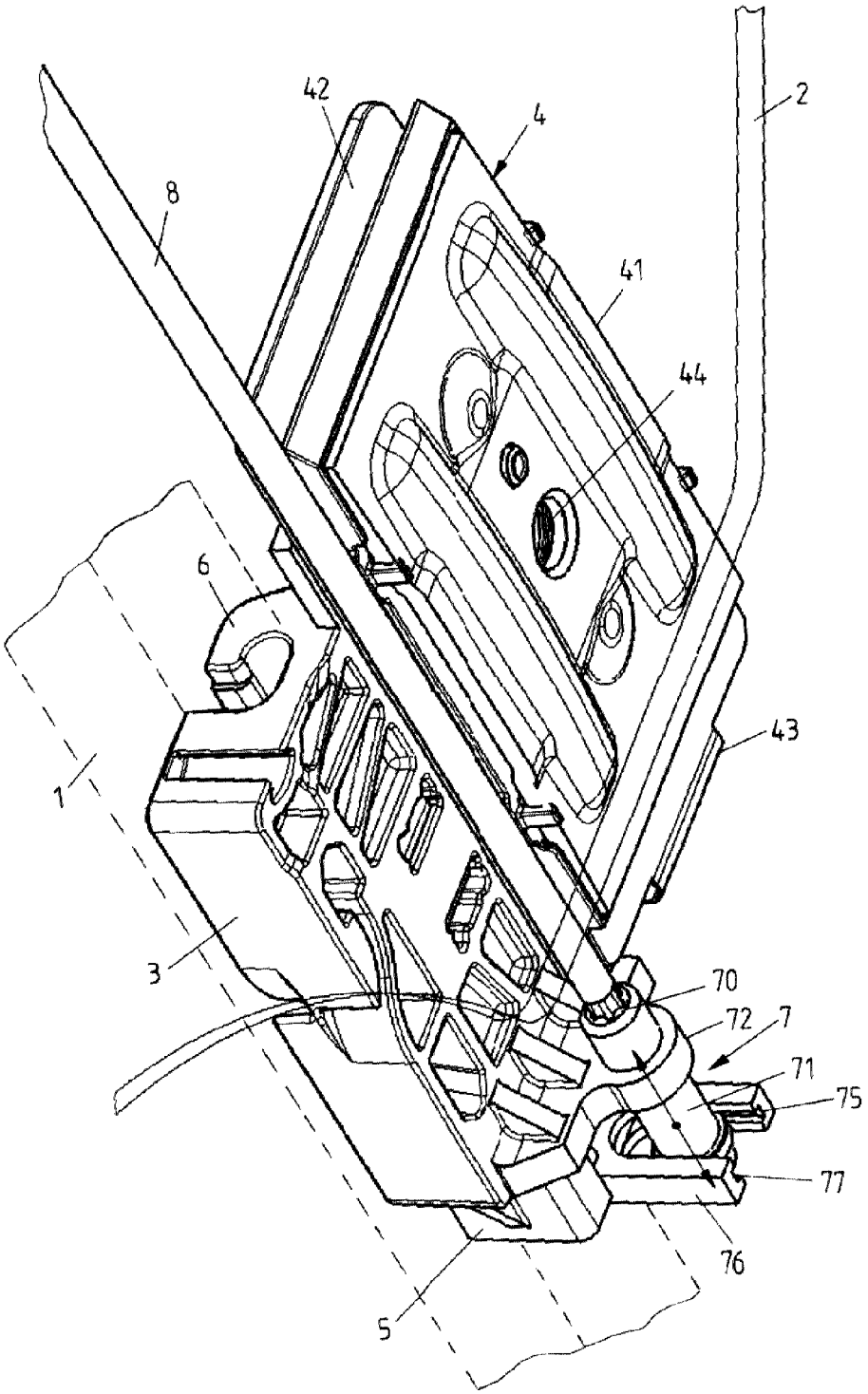
FIGS. 1 to 3 show various perspective views of a first embodiment of the carrier of the invention with a fixed and an adjustable guiding claw.
Figure 2:
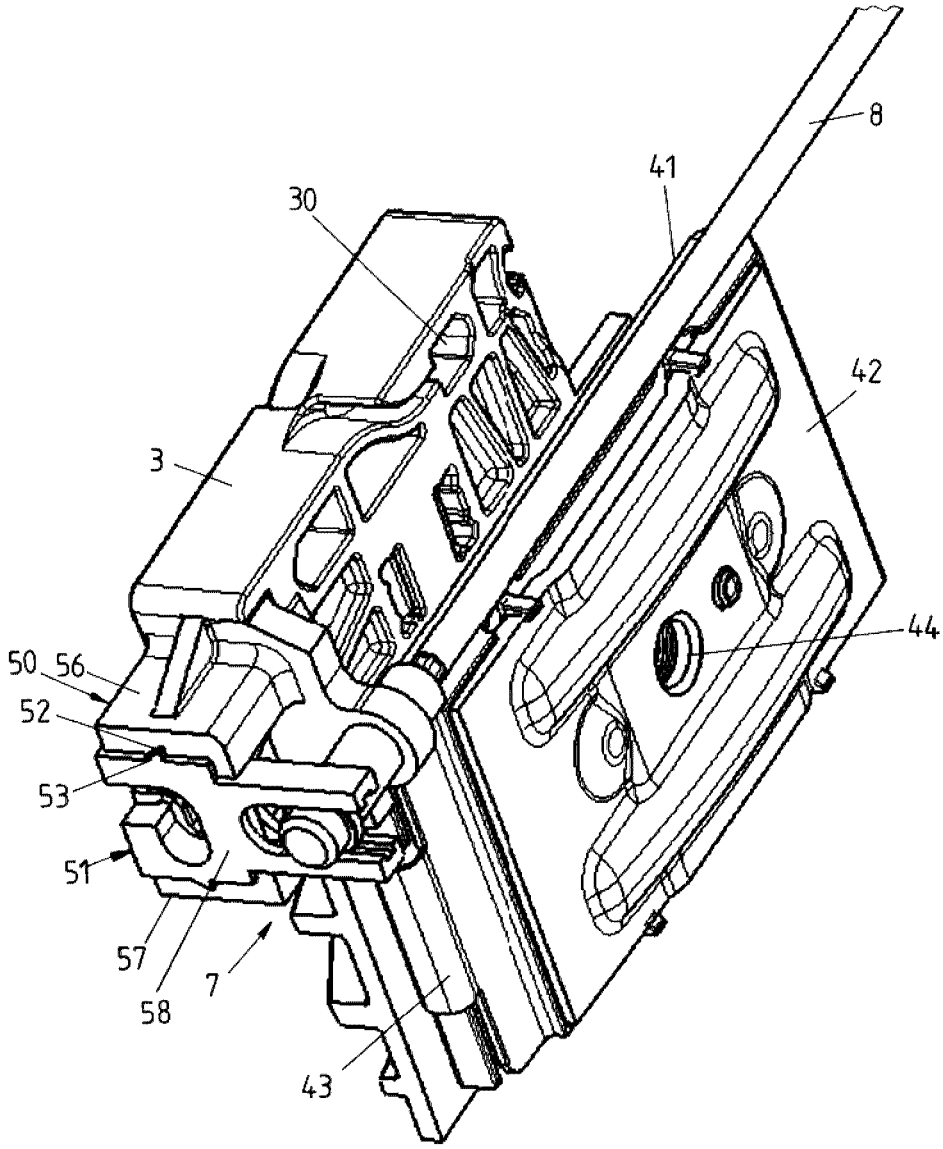
Figure 3:
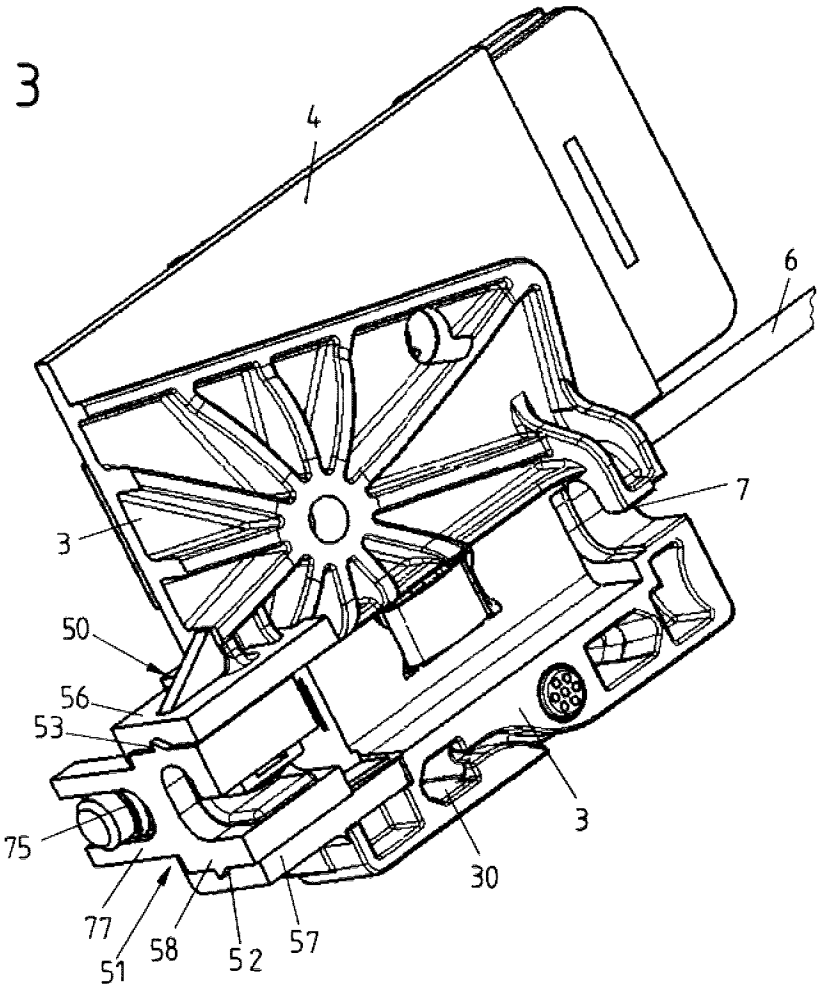
Figure 4:
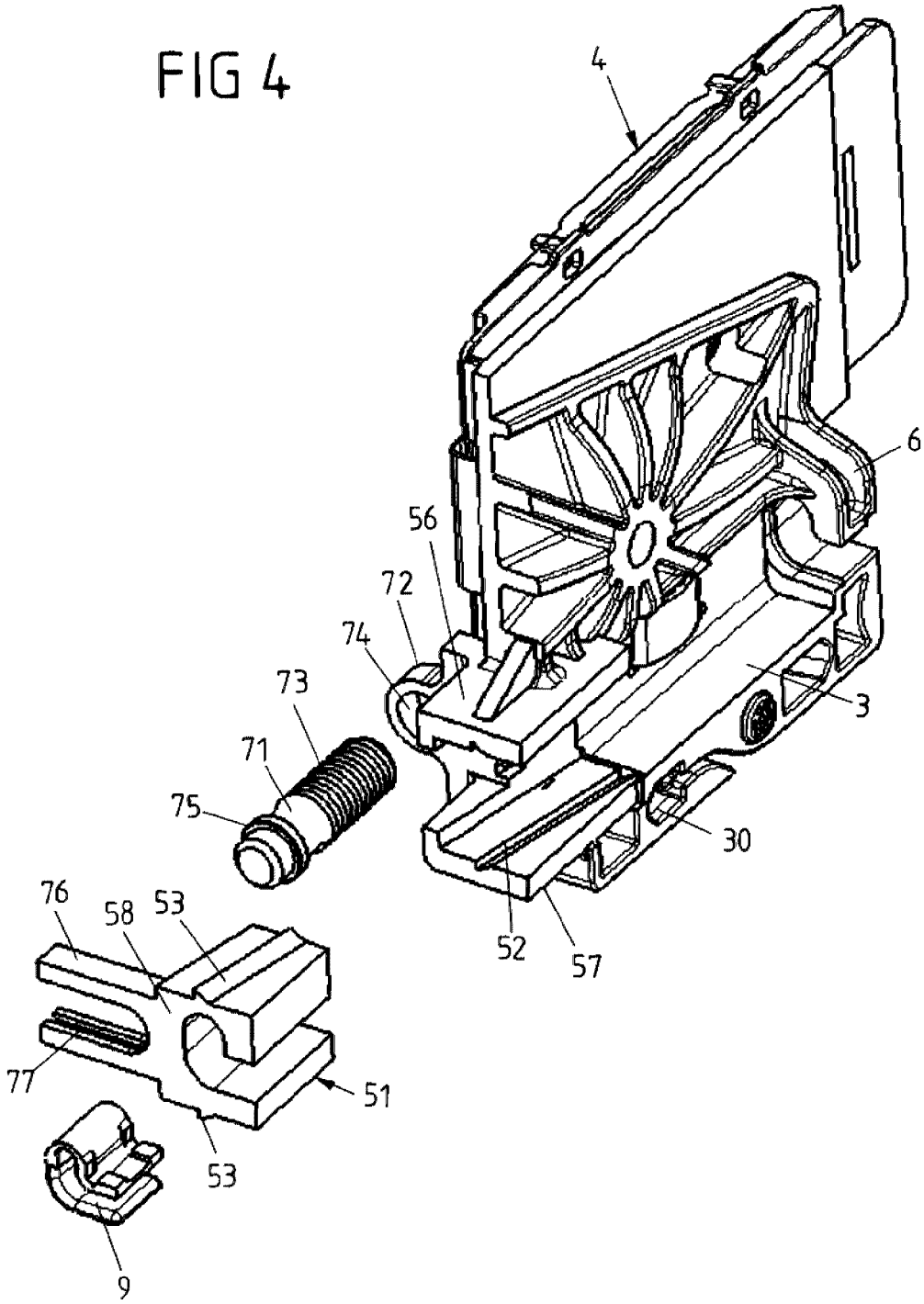
FIGS. 4 to 5 show perspective front and rear views of the first embodiment of the carrier of the invention with an exploded representation of the adjustable guiding claw.
Figure 5:
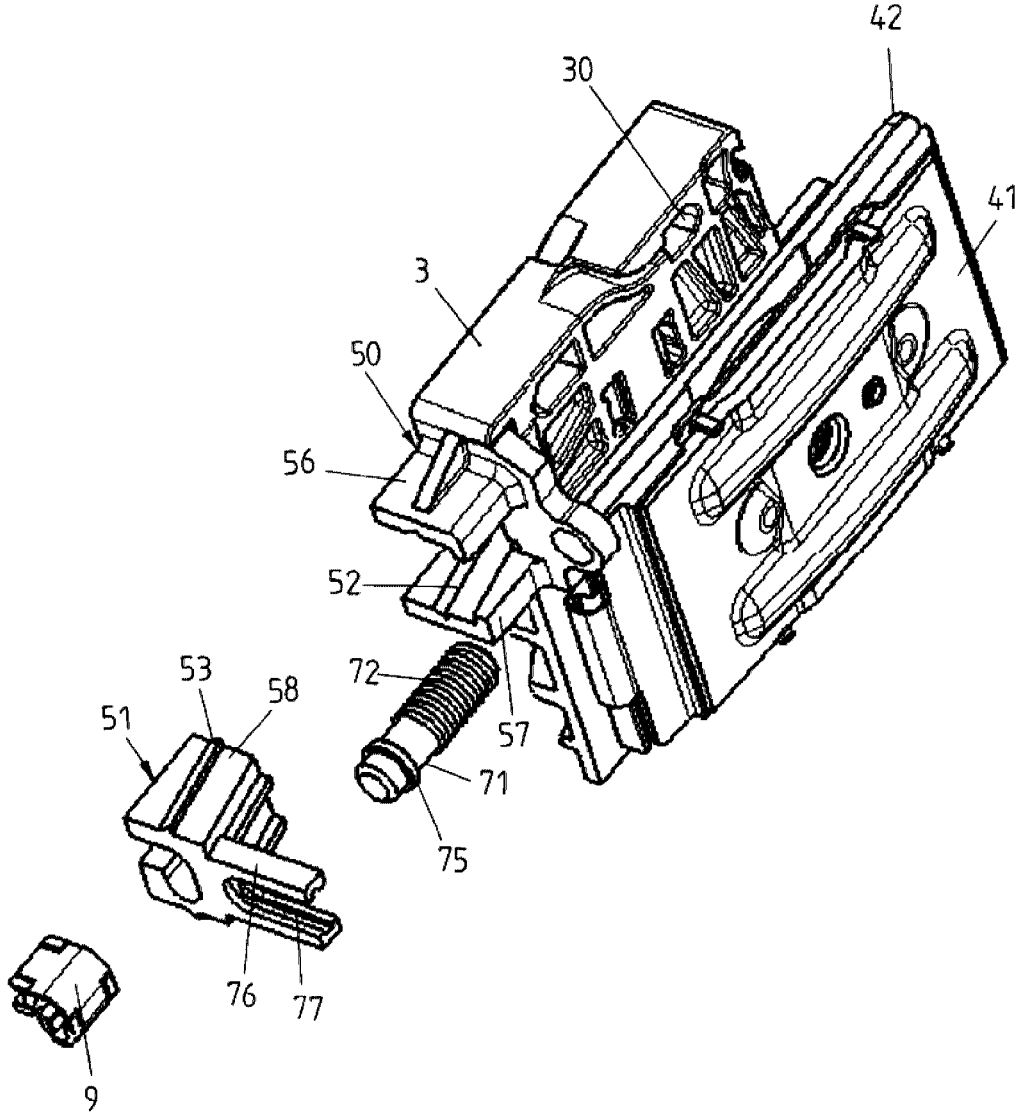

The carrier shown in FIGS. 1 to 5 in a perspective view includes a base body 3 and a holding body 4 firmly connected with the base body, which contains two holding jaws 41 connected with each other via a connection tab 43, between which a window pane 2 is clamped and firmly connected with the holding body 4 by means of a locking device 44. The base body 3 is mounted on a guide rail 1 shown in FIG. 1 in broken lines and is movable in longitudinal direction of the guide rail 1 for lifting and lowering the window pane 2, wherein the adjustment of the carrier on the guide rail 1 is effected via a non-illustrated Bowden cable which is provided with a nipple which is inserted into a nipple chamber 30 in the base body 3 and thus is connected with the carrier. By means of a likewise non-illustrated drive means, the carrier is shifted translatorily along the guide rail 1. The window lift containing the guide rail 1 and the carrier 3, 4 is mounted in a motor vehicle door and in particular in a frameless motor vehicle door for lifting and lowering the window pane 2.

The window pane 2 defines a window plane along which the window pane 2 extends in a state in which it is connected to the holding body 4 constituting a window pane holder for connecting the window pane 2 to the carrier.

To ensure that in a frameless motor vehicle door the window pane bears on the sealing contour of the motor vehicle body in a tightly sealing manner, the window pane 2 is pretensioned in the direction of the sealing contour, so that with closed window pane 2 and closed motor vehicle door a sufficient contact pressure of the window pane 2 against the sealing contour also is ensured at higher speeds and hence at a corresponding excess pressure in the vehicle interior. The tightly sealing bearing of the window pane 2 on the sealing contour of the motor vehicle body is achieved both by a corresponding alignment of the pull-off line of the window pane 2 with respect to the sealing contour of the motor vehicle body and also by a corresponding inclination of the window pane 2 towards the sealing contour.

As shown in FIG. 1, the guide rail 1 illustrated in broken lines includes a section which is embraced and engaged behind by two guiding claws 5, 6 arranged on the base body 3 at a distance from each other and thus ensures a safe guidance of the carrier 3, 4 and hence of the window pane 2 on the guide rail 1 of the window lift.

While the one guiding claw 6—the upper one in the embodiment—is firmly formed on the base body 3 of the carrier, the guiding claw 5—the lower one in the embodiment—is adjustable with a component of adjustment vertical to the longitudinal extension of the guide rail 1, i.e. in Y-direction of the motor vehicle with a window lift mounted in a motor vehicle door. For this purpose, the adjustable guiding claw 5 as shown in FIGS. 2 to 5 includes a connecting link guide 52, 53 extending at an angle with respect to the guide rail 1, which consists of connecting link guide grooves 52 in guide legs 56, 57 of a guiding claw holder 50 formed as part of the base body 3 of the carrier and of connecting link guide webs 53 slidingly engaging in the connecting link guide grooves 52 in an adjusting body of a movable guiding claw member 51 of the adjustably guiding claw 5. Due to this configuration of the connecting link guide 52, 53 the adjustable guiding claw 5 is adjusted in Z-direction, i.e. in direction of the vertical axis of the motor vehicle and hence with a corresponding alignment of the guide rail 1 in direction of the longitudinal extension of the guide rail 1 with a superposition in Y-direction of the motor vehicle, i.e. vertical to the longitudinal extension of the guide rail 1.

For adjusting the adjustable guiding claw 5 an adjustment gear 7 is used, which consists of an adjusting screw 71 with an external thread 73, an adjusting tab 72 with an internal thread 74, which is firmly and integrally connected with the base body 3 of the carrier, a coupling ring 75 formed on the adjusting screw 71 and a coupling groove 77 in a coupling claw 76, which is formed on the adjusting body 58 of the movable guiding claw member 51 of the adjustable guiding claw 5.

In the space surrounding the rail, which is formed by the adjustable guiding claw 5 and the fixed guiding claw 6, a sliding insert 9 is inserted to improve the sliding properties of the guiding claws 5, 6 on the guide rail 1.

The end of the adjusting screw 71 opposite the coupling ring 75 includes a tool holder 70, which includes an internal polygon, in particular a Torx holder, into which a turning tool 8, in particular in the form of a Torx tool, can be inserted. By rotating the turning tool 8 in the one or other direction of rotation, the adjusting screw 71 of the adjusting gear 7 is rotated in the corresponding direction, so that by engagement of the external thread 73 of the adjusting screw 71 into the internal thread 74 of the adjusting tab 72 firmly connected with the base body 3, the adjusting screw 71 is lifted or lowered in the direction of the double arrow shown in FIG. 1. In the process, the coupling ring 75 likewise is lifted or lowered. As a result of the engagement of the coupling ring 75 into the coupling groove 77 of the coupling claw 76, the coupling claw 76 is lifted or lowered together with the movable guiding claw member 51, wherein as a result of the connecting link guide 52, 53 with the connecting link guide grooves 52 and the connecting link guide webs 53 the adjustable guiding claw 5 is adjusted in Z-direction of the motor vehicle with a superimposed adjusting movement in Y-direction of the motor vehicle and the carrier thereby is swiveled about the fixed upper guiding claw 6. By means of the elongated coupling claw 76 it is ensured that the coupling ring 75 remains in engagement with the coupling groove 77 during the Y-Z adjusting movement.

By aligning the tool holder 70 in direction of the longitudinal extension of the guide rail 1 it is achieved that the turning tool 8 can be introduced for example through the upper slot of the door shaft and thereby the adjustment of the position and orientation of the window pane 2 in the completely mounted condition of the window lift can be effected with firmly mounted interior lining of the motor vehicle door. Alternatively, an adjustment through the bottom of the door shaft is possible, when a correspondingly closeable opening is provided at the door bottom.

Figure 6:
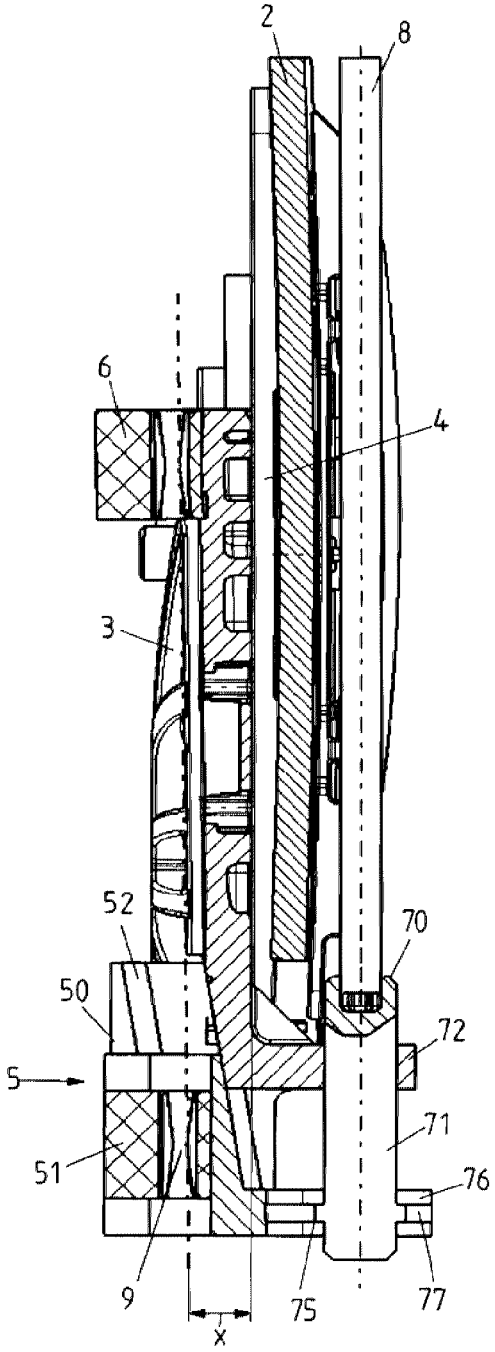
FIG. 6 shows a longitudinal section through the first embodiment of the carrier of the invention in a first setting of the adjustable guiding claw.
Figure 7:
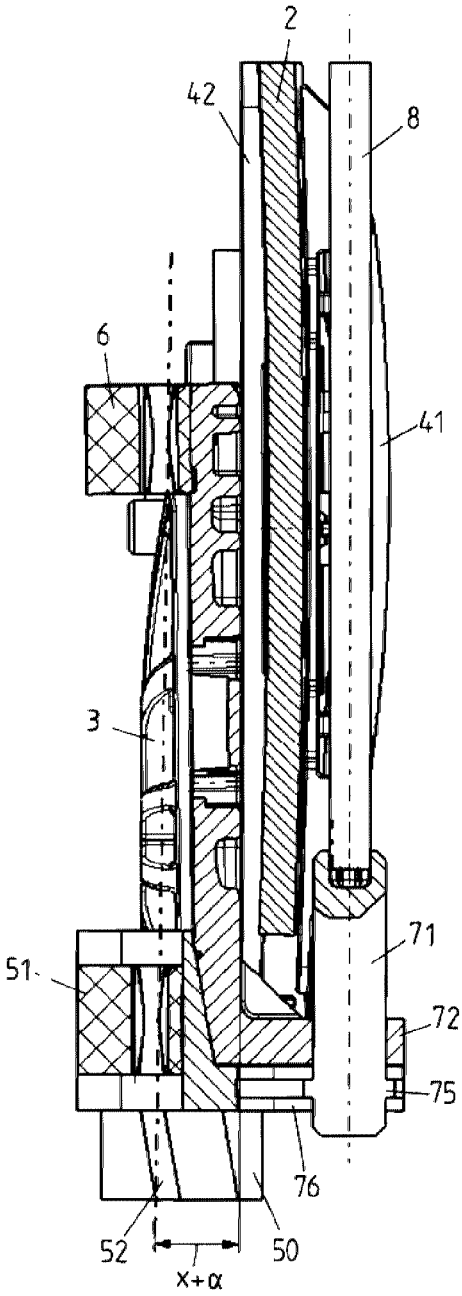
FIG. 7 shows a longitudinal section through the first embodiment of the carrier of the invention in a second setting of the adjustable guiding claw.
Figure 9:
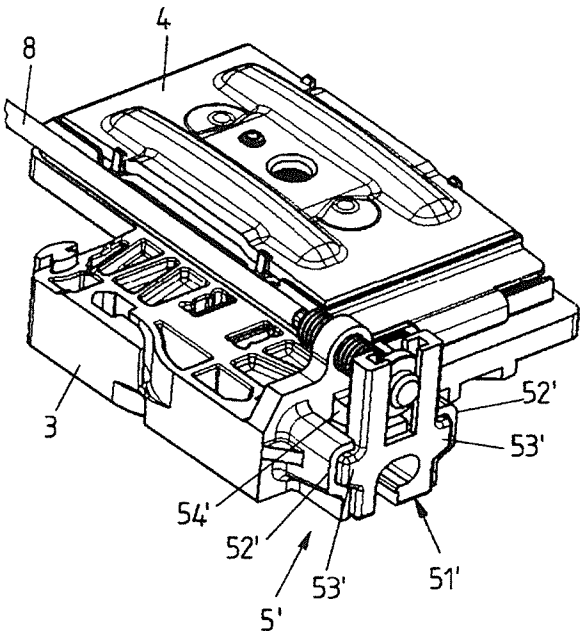
FIGS. 8 to 11 show perspective front and rear views of a second embodiment of the carrier of the invention with a partial exploded representation of an adjustable guiding claw.

The adjustment of the lower, adjustable guiding claw 5 is illustrated with reference to the longitudinal sections through the carrier as shown in FIGS. 6 and 7.

FIG. 6 shows the carrier in a starting position in which the lower, adjustable guiding claw 5 is at a distance x from the holding body 4 connected with the base body 3. In this setting, the movable guiding claw member 51 is in a lower position with respect to the guiding claw holder 50. By actuating the turning tool 8, the adjusting screw 71 is lifted with respect to the adjusting tab 72, i.e. the coupling ring 75 is moved towards the adjusting tab 72 and hence the coupling claw 76 together with the movable guiding claw member 51 is lifted along the connecting link guides 52, 53 in Z- and Y-direction of the motor vehicle, until the position shown in FIG. 7 is reached, in which the movable guiding claw member 51 with the sliding element 9 inserted therein, which embraces the guide rail, has a distance $x+\alpha$ from the holding body 4 of the carrier. The dash-dotted line illustrates that a swivel angle is obtained with respect to the pull-off line of the window pane 2 defined by the extension of the guide rail 1, as due to the adjustment of the adjustable guiding claw 5 and the fixed guiding claw 6 a corresponding swivel movement of the base body 3 of the carrier occurs around the fixed guiding claw 6.

Instead of the connecting link guides 52, 53 a combined connecting link and wedge-shaped guide can be provided for adjustment of an adjustable guiding claw 5' in Z-direction with a superposition of the adjusting movement in Y-direction corresponding to the embodiment described below with reference to FIGS. 8 to 13.

The embodiment shown in FIGS. 8 to 13 corresponds with the embodiment described above with reference to FIGS. 1 to 7 with the exception of the formation of the adjusting means of the movable guiding claw 5', so that with respect to the corresponding components reference is made to the above description, wherein in FIGS. 8 to 13 identical components are designated with reference numerals which correspond with the reference numerals of the components shown in FIGS. 1 to 7.

The embodiment shown in FIGS. 8 to 13 is characterized by improved guiding and sliding properties, since the guiding claw holder 50' connected with the carrier 3, 4 and the movable, adjustable guiding claw member 51' have larger guiding and sliding surfaces.

Figure 8:
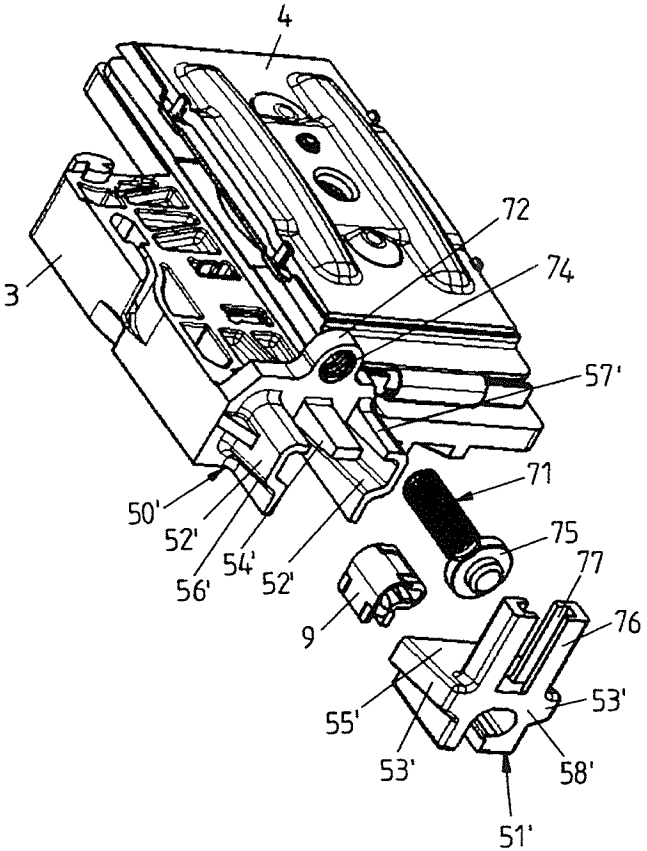
Figure 11:
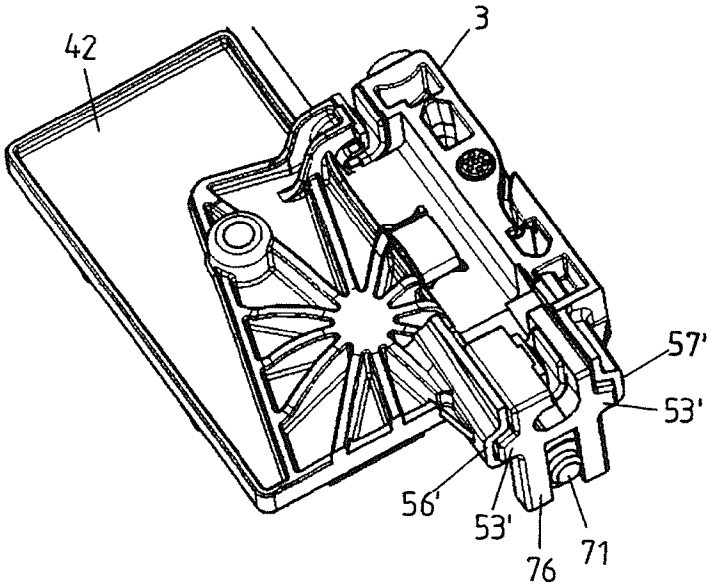
Figure 10:
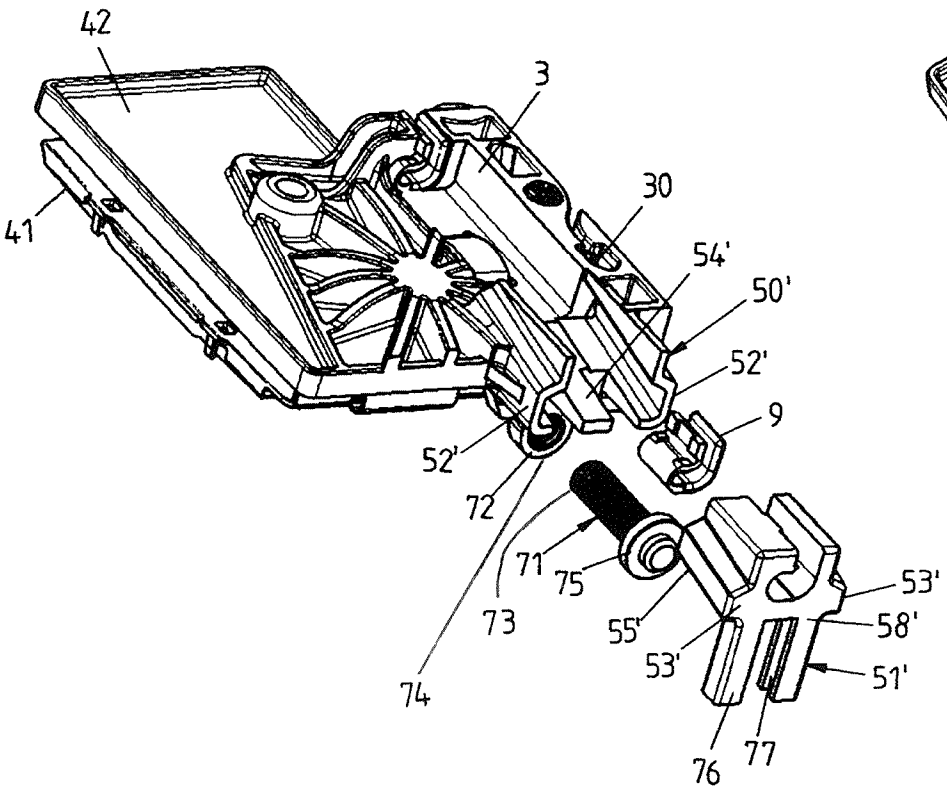
Figure 12:
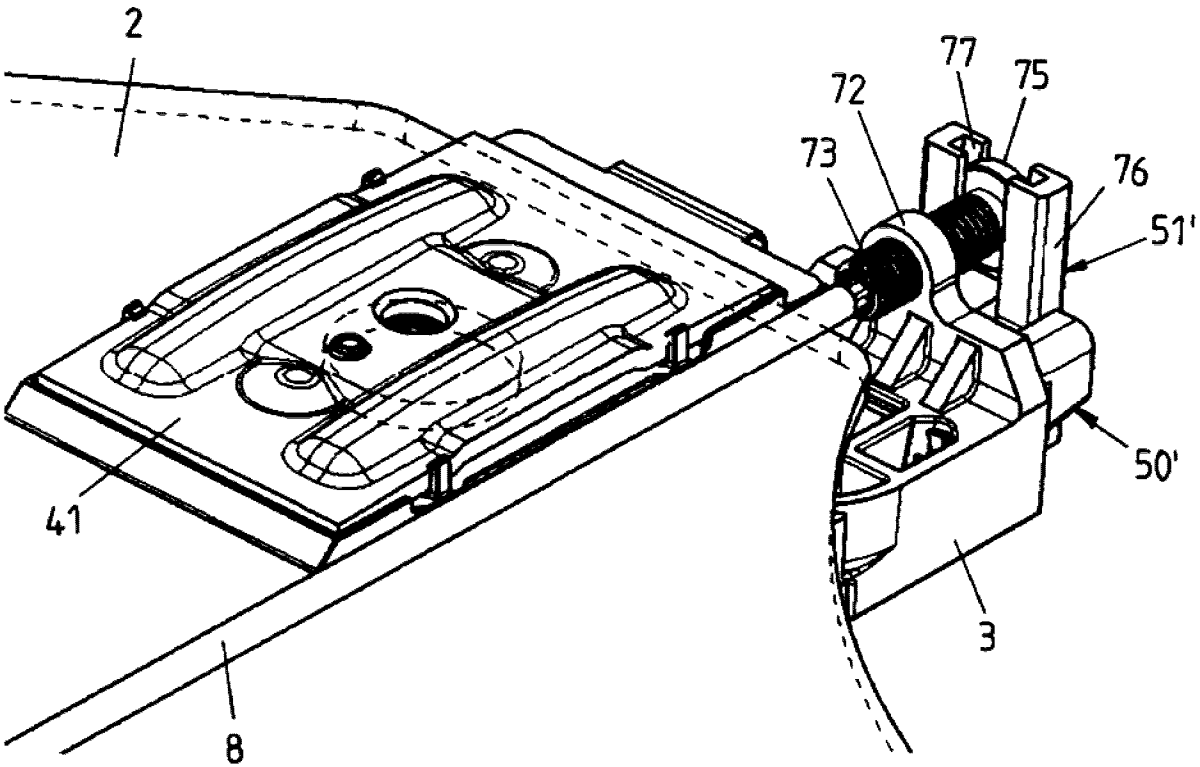
FIG. 12 shows a partial perspective view of the adjustable guiding claw of the carrier in the second embodiment.
Figure 13:
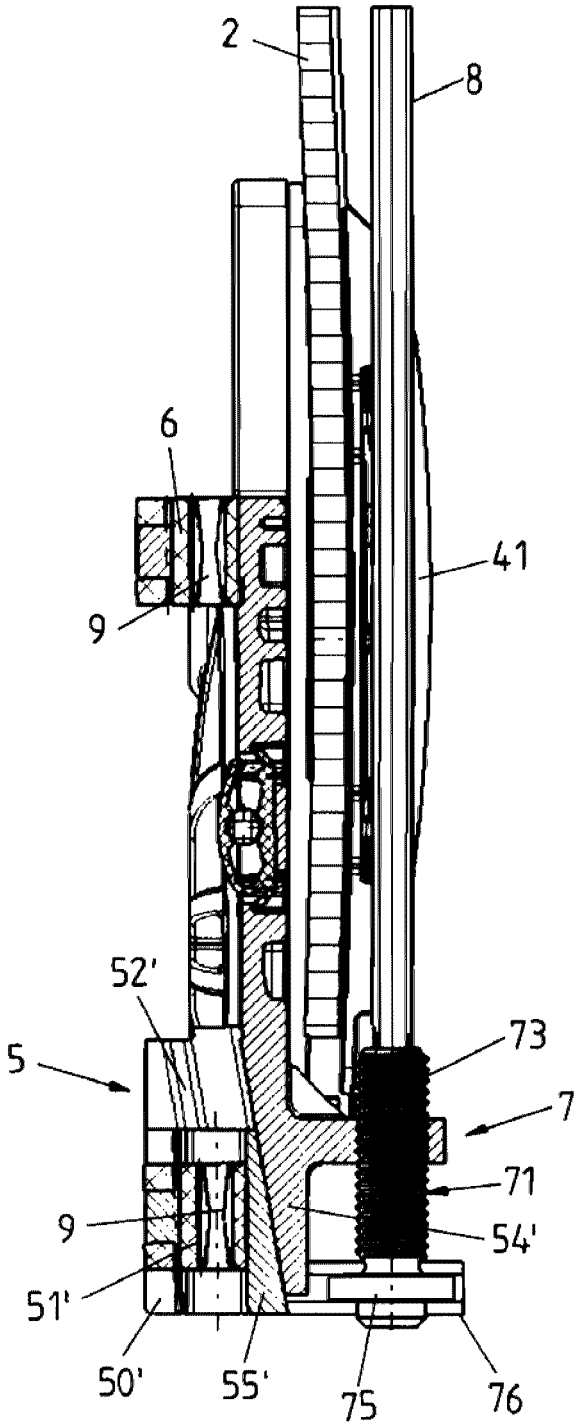
FIG. 13 shows a longitudinal section through the second embodiment of the carrier with the window pane clamped therein and with a turning tool inserted in the tool holder of the adjusting means.

In an isometric representation with exploded representation of the movable guiding claw 5', FIG. 8 shows the guiding claw holder 50' integrally connected with the base body 3 of the carrier 3, 4, which consists of two guide legs 56', 57' arranged parallel to and spaced from each other and of a guide tongue 54' arranged between the guide legs 56', 57', which is arranged centrally between the guide legs 56', 57' and spaced from the same. In the guide legs 56', 57' a box-shaped guide channel 52' is formed, which is aligned to extend at an angle with respect to the extension of the guide rail 1, i.e. at an angle with respect to the pull-off direction of the carrier 3, 4 and hence of the window pane 2 connected with the carrier 3, 4.

The movable guiding claw member 51' insertable in the guiding claw holder 50' consists of an adjusting body 58', in which an angled recess is arranged for holding the sliding and guiding member 9 and which includes laterally protruding guide webs 53' directed away from each other, which slidingly engage in the guide channels 52' of the guide webs 56', 57'. From the adjusting body 58', the coupling claws 76 protrude substantially vertically, which cooperate with the adjusting gear 71, 72, 75. In addition, the movable guiding claw member 51' on the adjusting body 58' includes an opposing guide surface 55, which corresponds with the guide surface of the guide tongue 54' of the guiding claw holder 50'.

Due to the box-shaped guide channels 52' and the large-surface guide surface 55' in conjunction with the guide tongue 54' a large sliding and guiding surface is provided, which increases the sliding and guiding properties of the adjustable guiding claw 5' of the second embodiment as compared to the first embodiment.

The embodiments described above with reference to FIGS. 1 to 13 permit numerous variants, some of which will briefly be outlined below.

Instead of a connecting link guide 52, 53 a wedge-shaped guide can be provided for adjusting the adjustable guiding claw 5 in Z-direction with a superposition in Y-direction.

By varying the angle included by the slotted guide 52, 53 with the pull-off line of the window lift, the degree of adjustment of the movable guiding claw 5 in Y-direction, which is superimposed on the adjustment in Z-direction, can be varied. With the same path of adjustment in Z-direction, the amount of the adjusting angle by which the base body 3 is swiveled with respect to the guide rail 1 about the fixed guiding claw 6 can be increased or decreased and the fineness of the adjusting movement can be increased or reduced, respectively.

Instead of an adjusting movement of the adjustable guiding claw 5 in Z-direction with superimposed adjustment in Y-direction, a purely translatory adjustment in Y-direction can be provided. This purely translatory Y-adjustment can be realized by means of an adjusting gear 7, in which for example the rotary movement of the turning tool 8 is converted into a shifting movement of the movable guiding claw member 51, 51' in Y-direction. An embodiment suitable for this purpose would be the arrangement of a pinion connected with the tool holder 70, whose teeth engage in teeth of the coupling claw 76 formed in the manner of a rack-and-pinion gear, which is integrally or in some other way connected with the movable guiding claw member 51, 51'.

Instead of an adjusting gear 7 formed in the manner of a rack-and-pinion gear, the adjusting gear 7 can consist of an eccentric gear in which the tool holder 70 is connected with an eccentric which is arranged in a bore of a coupling member which is connected with the movable guiding claw member 51, so that by rotating the eccentric an adjusting movement of the movable guiding claw is effected in Y-direction of the motor vehicle.

If an adjustable guiding claw likewise is provided instead of an upper guiding claw 5 firmly connected with the base body 3, the kind of adjustment of the carrier 3, 4 with respect to the guide rail 1 is varied further and, if necessary, the swivel angle with which the carrier 3, 4 can be swivelled with respect to the guide rail 1 can be increased.

If both adjustable guiding claws 5, 5', 6 are connected with a separate adjusting device, an adjustment with large swivel angle can be performed beside a purely translatory adjustment of the carrier in Y-direction of the motor vehicle, in that the adjustable guiding claws 5, 5', 6 are shifted with respect to each other in opposite directions. In addition, an adjustment of each of the two movable guiding claws 5, 5', 6 in Z-direction with superposition in Y-direction and a purely translatory adjustment in Y-direction is possible as described above.

With a common adjusting device for both movable guiding claws 5, 5', 6 both a common adjustment in Z-direction with superposition of an adjustment in Y-direction and a purely translatory adjustment in Y-direction of the carrier can be performed with respect to the guide rail.

What is claimed is:

1. A carrier assembly for connecting a window pane to a window lift of a motor vehicle, the carrier assembly comprising a guide rail and a carrier, wherein the carrier comprises:

at least two guiding claws spaced apart from each other in a longitudinal direction of the guide rail, the at least two guiding claws directly engaging the guide rail for guiding the carrier on the guide rail, wherein the at least two guiding claws extend around a section of the guide rail;

a base body which is guided on the guide rail of the window lift via the at least two guiding claws, the at least two guiding claws being directly on the base body;

a window pane holder to connect the window pane with the carrier, the window pane holder having a recess for receiving the window pane, wherein the window pane, in a mounted state in which the window pane is in the recess and is connected to the window pane holder, substantially extends along a window plane;

a holding body of the window pane holder fixedly connected with the base body for holding the window pane; and an adjusting device to adjust at least one of the position and the orientation of the window pane with respect to the guide rail, wherein at least one of the at least two guiding claws is adjustable, perpendicularly to a direction of longitudinal extension of the guide rail, relative to the base body in at least one direction extending substantially perpendicular to the window plane.

2. The carrier assembly according to claim 1, wherein the adjustable guiding claw is linearly adjustable.

3. The carrier assembly according to claim 1, wherein the adjustable guiding claw is adjustable in a direction perpendicular to the direction of longitudinal extension of the guide rail and also along the direction of the longitudinal extension of guide rail.

4. The carrier assembly according to claim 3, wherein the adjustable guiding claw is linearly adjustable in a direction perpendicular to the direction of longitudinal extension of the guide rail with a superimposed adjustment movement along the direction of longitudinal extension of the guide rail.

5. The carrier assembly according to claim 1, wherein a second guiding claw is non-adjustably guided on the guide rail.

6. The carrier assembly according to claim 1, wherein the adjusting device includes an adjustor formed on the adjustable guiding claw and which is adjustable perpendicular to the direction of longitudinal extension of the guide rail or adjustable both perpendicularly to the direction of longitudinal extension of the guide rail and along the direction of longitudinal extension of the guide rail.

7. The carrier assembly according to claim 6, further comprising at least one of a wedge-shaped and a connecting link guide for the adjustment of the adjustor.

8. The carrier assembly according to claim 7, wherein the wedge-shaped or connecting link guide extends vertically or at an angle to the longitudinal extension of the guide rail.

9. The carrier assembly according to claim 6, wherein the adjustor includes a guiding claw holder, which is connected with the base body or formed on the base body, and a movable guiding claw member guided in the guiding claw holder.

10. The carrier assembly according to claim 9, wherein the guiding claw holder includes two guide legs with guides arranged thereon, which guide legs extend parallel to each other and are spaced from each other, and wherein the movable guiding claw member includes an adjusting body with counter-guides engaging in the guides and slidingly adjustable in the guides.

11. The carrier assembly according to claim 10, wherein the guides and counter-guides are formed as connecting link guides with grooves and webs slidingly guided therein.

12. The carrier assembly according to claim 10, wherein the guides are configured as box-shaped profiles formed in the guide legs and extending at an angle with respect to the direction of longitudinal extension of the guide rail and as a guide tongue arranged between the guide legs with a guide surface aligned parallel to an extension of the box sections, and the counter-guides are configured as guide webs engaging in the box sections and protruding from the adjusting body and as a movable guide surface bearing on the guide surface of the guide tongue and sliding along the same upon adjustment of the movable guiding claw member.

13. The carrier assembly according to claim 12, wherein the guide tongue is arranged centrally between and spaced from the guide legs.

14. The carrier assembly according to claim 1, wherein the adjusting device includes a tool holder for a turning tool and an adjusting gear which converts a rotation of the turning tool into a linear adjusting movement of the adjustor.

15. The carrier assembly according to claim 14, wherein the adjusting gear comprises a helical gear which includes an adjusting tab connected with a base body or formed in the base body with an internal thread and an adjusting screw with an external thread and a screw shank which is adjustable via the tool holder, whose external thread is in engagement with the internal thread of the adjusting tab and whose screw shank is provided with a coupling ring which engages in a coupling groove of a coupling claw connected with a movable guiding claw member of the adjustable guiding claw.

16. The carrier assembly according to claim 14, wherein the tool holder is aligned parallel to the longitudinal extension of the guide rail.

17. The carrier assembly according to claim 14, wherein the tool holder comprises an internal polygon, into which a turning tool provided with an external polygon engages.

* * * * *